US005218897A

United States Patent [19]

Shirai et al.

[11] Patent Number: 5,218,897

[45] Date of Patent: Jun. 15, 1993

[54] HYDRAULIC CIRCUIT APPARATUS FOR OPERATING WORK-IMPLEMENT ACTUATING CYLINDERS

[75] Inventors: Kiyoshi Shirai; Terruo Akiyama; Shigeru Shinohara; Naoki Ishizaki; Takahide Takiguchi, all of Kasawaki, Japan

[73] Assignee: Kabushiki Kaisha Komatsu Seisakusho, Japan

[21] Appl. No.: 655,351

[22] PCT Filed: Jun. 26, 1990

[86] PCT No.: PCT/JP90/00829

§ 371 Date: Feb. 22, 1991

§ 102(e) Date: Feb. 22, 1991

[87] PCT Pub. No.: WO91/00431

PCT Pub. Date: Jan. 10, 1991

[30] Foreign Application Priority Data

Jun. 26, 1989 [JP] Japan ..... 1-160871
Jun. 26, 1989 [JP] Japan ..... 1-160873

[51] Int. Cl.[5] ..... F15B 13/04

[52] U.S. Cl. ..... 91/436; 91/447; 91/451; 137/596.13

[58] Field of Search ..... 91/416, 436, 451, 420, 91/447; 137/596.12, 596.13, 596.14

[56] References Cited

U.S. PATENT DOCUMENTS 3,477,347 11/1969 Rice .
4,411,189 10/1983 Miller ..... 91/436

FOREIGN PATENT DOCUMENTS 2537184 6/1984 France .
45-36184 11/1970 Japan .
58-163875 9/1983 Japan .
62-105895 5/1987 Japan .
1045785 10/1966 United Kingdom .
2181519 4/1977 United Kingdom .
2199115 6/1988 United Kingdom .

*Primary Examiner*—Edward K. Look
*Assistant Examiner*—F. Daniel Lopez
*Attorney, Agent, or Firm*—Ronald P. Kananen

[57] ABSTRACT

This invention provides a hydraulic circuit apparatus for operating a work-implement actuating cylinder arranged such that, during an earth compacting operation using a bucket, a work implement or boom is lowered by its own weight, and during other operations, a part of the fluid under pressure in a lifting chamber of the actuating cylinder is supplied together with pressurized fluid discharged by a pump into a lowering chamber to increase the retracting speed of a piston rod in the work-implement actuating cylinder. The apparatus comprises a spool slidably inserted in a valve bore formed in an operating valve body so that it may be moved between a first actuating position, where a second port connected to the lowering chamber is communicated with a second tank port and a first port connected to the lifting chamber is communicated with a first pump port; and a second actuating position, where the second port is communicated with a second pump port and the first port is communicated with a first tank port. A regenerative fluid passage, including a check valve, is formed in the valve body so as to allow the first and second ports to communicate together.

6 Claims, 4 Drawing Sheets

THE PRIOR ART

HYDRAULIC CIRCUIT APPARATUS FOR OPERATING WORK-IMPLEMENT ACTUATING CYLINDERS

TECHNICAL FIELD OF THE INVENTION

This invention relates to a hydraulic circuit apparatus for supplying fluid under pressure into work implement actuating cylinders to drive work implements such as a boom, an arm and a bucket, etc. mounted on an earth moving vehicle such as a power shovel, etc.

BACKGROUND ART OF THE INVENTION

A boom and arm type work implement provided with a bucket has a boom mounted thereon so that it may be swung up and down by a boom actuating cylinder, an arm connected to the boom so that it may be swung up and down by an arm actuating cylinder, and a bucket connected to the arm so that it may be swung up and down by a bucket actuating cylinder, and is arranged such that the boom, the arm and the bucket are swung up and down to conduct earth excavation work.

The hydraulic circuit for operating this boom and arm type work implement is arranged such that the fluid under pressure discharged by a hydraulic pump is supplied by a boom operating valve into the boom actuating cylinder, the fluid under pressure is supplied by an arm operating valve into the arm actuating cylinder, and the fluid under pressure is also supplied by a bucket operating valve into the bucket actuating cylinder.

The hydraulic circuit for supplying the fluid under pressure discharged by a hydraulic pump by an operating valve into a work implement lifting side chamber and a work implement lowering side chamber of each of the work implement actuating cylinders so as to extend and retract the piston rod in each of the cylinders is well known.

As the operating valves for use with such a hydraulic circuit, a closed-center type operating valve is heretofore known. This closed-center type operating valve is suitable for use in case a plurality of operating valves are operated simultaneously to supply the fluid under pressure discharged by a single hydraulic pump into a plurality of hydraulic cylinders, since when the operating valve is located at its neutral position the pump port thereof is shut off.

The closed-center operating valve has a neutral position where a pump port, a tank port, a first port, and a second port are shut off, a first actuating position where the pump port is communicated with the first port, and the tank port is communicated with the second port, and a second actuating position where the pump port is communicated with the second port, and the tank port is communicated with the first port. This operating valve is arranged such that it is changed over to each of the above-mentioned positions when a spool slidably inserted in the valve body is moved; that is, when the spool is moved from its neutral position towards its first actuating position the tank port is communicated with the second port to thereby open the metering-out side, and when the spool is further moved in the same direction the pump port is communicated with the first port to thereby open the metering-in side, and the area of opening of each port is increased in proportion to the stroke of the spool. This effect can be seen with reference to FIG. 1.

This is applicable to the case where the spool is changed over to the second actuating position.

Further, there are cases where the boom of a boom-and-arm type work implement is lowered by its own weight so as to bring the bucket into contact with the ground to conduct earth compacting operation. In such cases, the boom operating valve is operated from its neutral position to a position where the metering-out side is opened and the metering-in side is opened slightly so as to lower the boom by its own weight.

However, the stroke of the spool which occurs until the metering-in side is opened after the metering-out side is opened is very short, as shown in FIG. 1, and therefore the spool is sometimes moved to a position where the metering-in side is widely opened and the pressure within the boom lowering side chamber is raised with the result that the boom is lowered forcibly by the action of the boom actuating cylinder. As a result, the bucket is vigorously pushed against the ground thus raising the vehicle body, which makes it difficult to conduct earth compacting operation using the bucket.

In brief, even if the stroke of the spool until the metering-in side is opened after the metering-out side is opened is increased, the piston rod in the boom actuating cylinder cannot be retracted until the metering-in side is opened, and therefore it is required to move the spool until the meterin-in side is opened slightly.

Further, in cases where operations other than the above-mentioned earth compacting operation are conducted, quick operation of the work implement is required to conduct the operations quickly.

In order to increase the operating speed of the boom actuating cylinders in the above-mentioned hydraulic circuit, the arrangement is made such that the fluid under pressure returning from the boom lifting side chamber is supplied partially into the boom lowering side chamber so as to quickly extend and retract the piston rod in the boom actuating cylinder.

For example, the operating valve has a fluid passage formed in the spool and a check valve so that when fluid under pressure is supplied into the boom lowering side chamber of the boom actuating cylinder a part of the pressurized fluid returning from the boom lifting side chamber may be supplied through the fluid passage and the check valve into the boom lowering side chamber, or alternatively a regenerative valve is provided in a connection circuit between the operating valve and the boom actuating cylinder so that the fluid under pressure returning from the boom lifting side chamber can be supplied directly into the boom lowering side chamber without through the operating valve.

In the case of the former arrangement, since the fluid passage formed in the spool is subjected to a constraint by the diameter of the spool, the sectional area of the fluid passage is limited, thus increasing the resistance to flow of fluid under pressure, which increases the pressure loss.

In the case of the latter construction, since the regenerative valve is installed separately from the operating valve, piping arrangement becomes complicated.

SUMMARY OF THE INVENTION

The present invention has been made in view of the above-mentioned circumstances in the prior art, and its object is to provide a hydraulic circuit apparatus for operating a work-implement actuating cylinder arranged such that the metering-in side is opened after the metering-out side is opened, and simultaneously with opening of the metering-out side the work-implement lifting side chamber of the work-implement actuating cylinder is allowed to communicate with the work-implement lowering side chamber thereof through a regenerative circuit so that the piston rod in the work-implement actuating cylinder can be retracted by the weight of the work-implement without having to open the metering-in side to thereby enable the work-implement to be lowered under the influence of its own weight.

Another object of the present invention is to provide a hydraulic circuit apparatus for operating a work-implement actuating cylinder arranged such that when the pressurized fluid discharged by the pump is supplied into the work-implement lowering side chamber of the work-implement actuating cylinder the pressurized fluid in the work-implement lifting side chamber can be supplied together with the fluid discharged by the hydraulic pump into the work-implement lowering side chamber.

To achieve the above-mentioned objects, according to a first aspect of the present invention, there is provided a hydraulic circuit apparatus for operating a work-implement actuating cylinder so as to supply the pressurized fluid discharged by a hydraulic pump through a closed-center type operating valve into a work-implement lowering side chamber and a work-implement lifting side chamber of the work-implement actuating cylinder, the hydraulic circuit apparatus comprising: a spool slidably inserted in a valve hole formed in the body of the operating valve so that it may be moved between a first actuating position where a second port of the operating valve connected with the work-implement lowering side chamber is communicated with a second tank port, and at the same time a first port of the operating valve connected with the work-implement lifting side chamber is communicated with a first pump port, and a second actuating position where the second port connected with the work-implement lowering side chamber is communicated with a second pump port, and at the same time the first port connected with the work-implement lifting side chamber is communicated with a first tank port; a regenerative fluid passage formed in the valve body so as to allow the first port connected with the work-implement lifting side chamber to communicate with the second port connected with the work-implement lowering side chamber; and a check valve mounted in the regenerative fluid passage.

According to a second aspect of the present invention, there is provided a hydraulic circuit apparatus for operating a work-implement actuating cylinder as set forth in the above-mentioned first aspect, characterized in that it is constructed such that when the spool is moved from its neutral position towards its second actuating position where the fluid under pressure discharged by the hydraulic pump is supplied into the work-implement lowering side chamber only the metering-in side is opened, and at the same time, the first port is communicated through the regenerative fluid passage with the second port, and subsequently when the spool is further moved to its second actuating position the second pump port on the metering-in side is communicated with the second port in the condition wherein the first port is kept in communication through the regenerative fluid passage with the second port.

Further, according to a third aspect of the present invention, there is provided a hydraulic circuit apparatus for operating a work-implement actuating cylinder as set forth in the above-mentioned first aspect, characterized in that it is constructed such that when the spool is moved to its second actuating position the first port is communicated through the regenerative fluid passage with the second port so that the fluid under pressure in the work-implement lifting side chamber is supplied together with the fluid under pressure discharged by the hydraulic pump into the work-implement lowering side chamber.

The present invention having the above-mentioned aspects incorporated therein provides the following advantages.

Firstly, when the spool which is slidably mounted in the operating valve installed in the hydraulic circuit apparatus, is moved from its neutral position to its second actuating position where fluid under pressure is supplied into the work-implement lowering side chamber of the work-implement actuating cylinder, only the metering-out side is opened, and also the first port connected with the work-implement lifting side chamber is communicated through the regenerative fluid passage with the second port connected with the work-implement lowering side chamber so that the fluid under pressure in the work-implement lifting side chamber is supplied partially into the work-implement lowering side chamber to thereby enable the work-implement to be lowered by the weight thereof. Therefore, since in this condition, the second pump port on the metering-in side is not allowed to communicate with the second port, the stroke of the spool until the above-mentioned communicating condition on the metering-in side is established after the metering-out side is opened is increased so that when the work-implement is lowered there is no possibility of the work-implement being lowered forcibly by the action of the work-implement actuating cylinder, thus providing a suitable condition for earth compacting operation using the bucket.

At the same time, in case operations other than earth compacting operation are conducted, when the fluid under pressure discharged by the hydraulic pump is supplied into the work-implement lowering side chamber of the work-implement actuating cylinder, a part of the fluid under pressure in the work-implement lifting side chamber is supplied through the regenerative fluid passage into the work-implement lowering side chamber together with the fluid discharged by the pump, so that the piston rod in the work-implement actuating cylinder can be quickly retracted to thereby enable the work-implement to be operated quickly.

Further, since the above-mentioned regenerative fluid passage in which the check valve is mounted is not formed in the spool, but in the operating valve body, the diameter of the regenerative fluid passage can be increased without being constrained by the diameter of the spool, so that the pressure losses in the regenerative fluid passage can be reduced, and also the provision of special piping is not required.

The above-mentioned and other objects, aspects and advantages of the present invention will become apparent to those skilled in the art by making reference to the following description and the accompanying drawings in which preferred embodiments incorporating the principles of the present invention are shown by way of example only.

DETAILED DESCRIPTION OF PREFERRED EMBODIMENTS

Several embodiments of the present invention will now be described in detail below with reference to the accompanying drawings.

Figure 1:
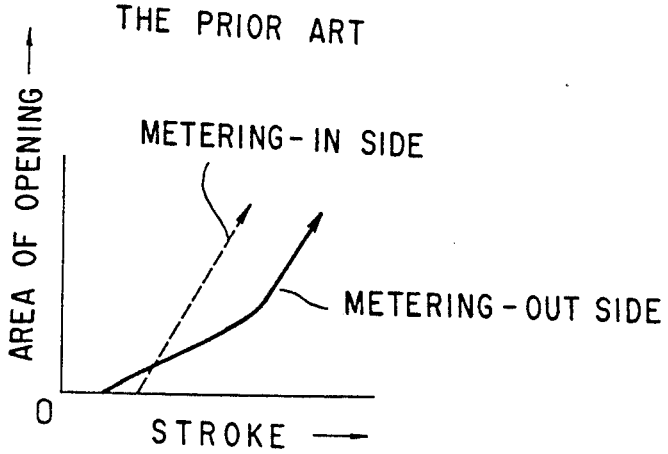
FIG. 1 is a graph showing the relationship between the stroke of a spool of an operating valve used in a prior art hydraulic circuit apparatus of the kind specified above and the area of opening on each of metering-in and metering-out sides thereof.
Figure 2:
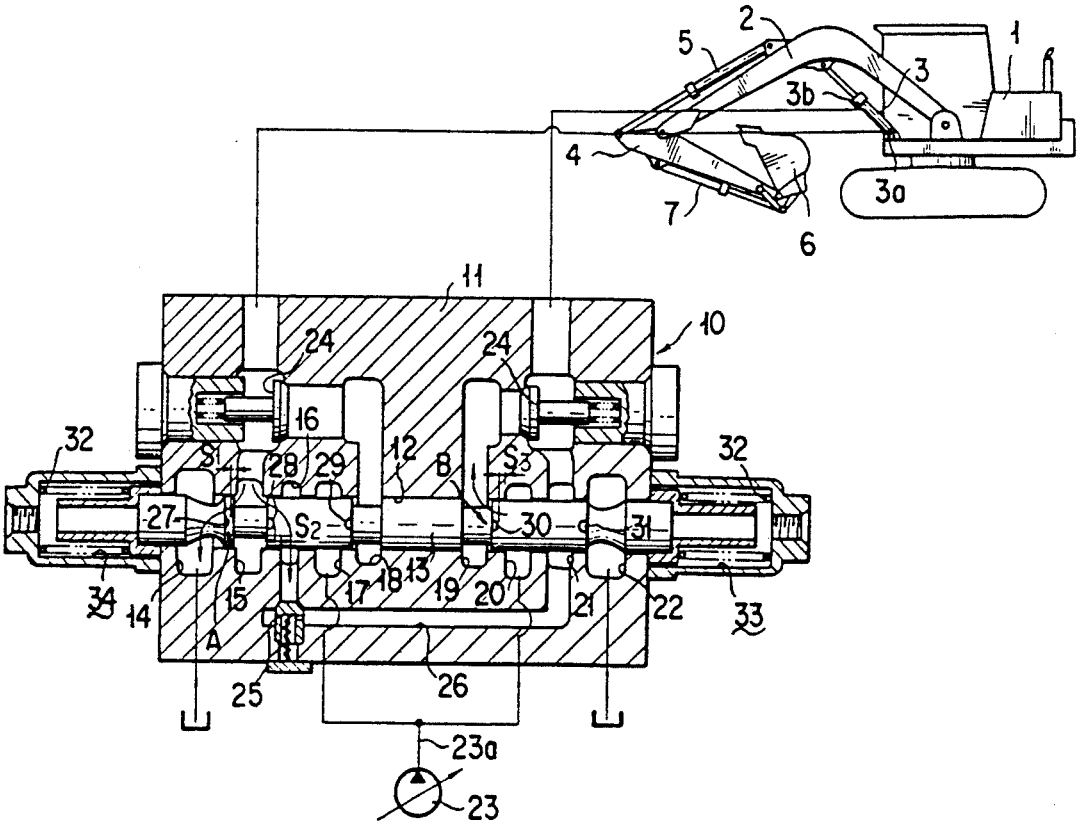
FIG. 2 is an overall, schematic configurational view showing a first embodiment of the present invention.

As shown in FIG. 2, a vehicle body 1 has a work-implement (a boom) 2 mounted thereon so that it may be swung up and down by the action of a boom actuating cylinder 3. Further, an arm 4 is connected to the boom 2 so that it may be swung up and down by the action of an arm actuating cylinder 5, the arm 4 having a bucket 6 mounted thereon so that it may be swung up and down by the action of a bucket actuating cylinder 7, thus forming a boom and arm type work implement provided with a bucket.

An operating valve 10 for actuating the work implement or boom 2 comprises a spool 13 slidably inserted in a spool hole 12 formed in a valve body 11. The spool hole 12 in the valve body 11 has formed therewith in turn in longitudinally spaced-apart relationship a first tank (or reservoir) port 14, a first port 15, a regenerative port 16, a first pump port 17, a first outlet port 18, a second outlet port 19, a second pump port 20, a second port 21, and a second tank (or reservoir) port 22. The first and second tank ports 14 and 22 communicate a fluid tank or reservoir. The first port 15 is connected to a boom lifting side chamber 3*a* of the boom actuating cylinder 3, whilst the second port 21 is connected to a boom lowering side chamber 3*b*. The first and second pump ports 17 and 20 are connected to a discharge path 23*a* of a pump 23. The first outlet port 18 is allowed to communicate with through a check valve 24 with the first port 15 whilst the second outlet port 19 is allowed to communicate through a check valve 24 with the second port 21. The regenerative port 16 is allowed to communicate through a check valve 25 and a fluid passage 26, which form a regenerative fluid passage, with the second port 21.

The above-mentioned spool 13 is formed with a first cut-away groove 27 for communicating the first tank port 14 with the first port 15, a second cut-away groove 28 for communicating the first port 15 with the regenerative port 16, a third cut-away groove 29 for communicating the first pump port 17 with the first outlet port 18, a fourth cut-away groove 30 for communicating the second outlet port 19 with the second pump port 20, and a fifth cut-away groove 31 for communicating the second port 21 with the second tank port 22. The spool 13 is held at its neutral position by the resilient force of a spring 32, and is arranged to be changed over to a first actuating position I by the action of pilot fluid under pressure supplied into a first pressure receiving chamber 33, and to a second actuating position II by the action of pilot fluid under pressure supplied into a second pressure receiving chamber 34.

The operation of the hydraulic circuit apparatus of the present invention will now be described below.

When the spool 13 is slidably moved to the second actuating position II (to the right hand in the drawing) by supplying pilot fluid under pressure into the second pressure receiving chamber 34, the first port 15 is connected through the cut-away groove 27 with the first tank port 14 thereby opening the metering-out side A only, and at the same time the first port 15 is connected through the second cut-away groove 28 with the regenerative port 16. However, the fourth cut-away groove 30 is not yet allowed to open into the second pump port 20, and hence communication between the second pump port 20 and the second outlet port 19 is not yet established and thus maintains the metering-in side B closed. To meet this operating condition, it is required that the relationship between the lengths of the first, second and fourth cut-away grooves is defined by $S_1 = S_2 > S_3$.

As a result, the fluid under pressure within the boom lifting side chamber 3*a* in the boom actuating cylinder 3 will flow into the first tank port 14 and the regenerative port 16; and then flow therefrom into the check valve 25 after pushing it open into the fluid passage 26, and then through the second port 21 into the boom lowering side chamber 3*b*, thereby allowing the boom 2 to move down by its own weight.

Figure 3:
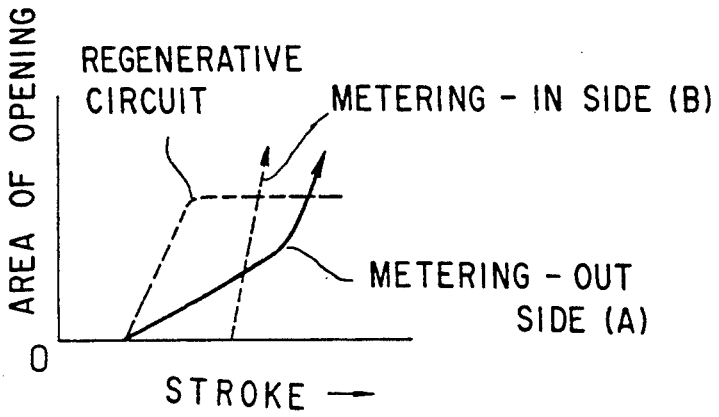
FIG. 3 is a graph showing the relationship between the stroke of a spool of the operating valve used in the embodiment of the present invention shown in FIG. 2 and the area of opening on each of metering-in and metering-out sides thereof.

Thus, since the piston rod in the boom actuating cylinder 3 can be retracted by the weight of the boom 2 only by opening the metering-out side A, the stroke length of the spool 13 which occurs until the metering-in side B is opened after the metering-out side A is opened can be increased as shown by the graph in FIG. 3, so that the metering-in side B cannot be opened in a short time, and also during the earth compacting operation by means of the bucket 6, fluid under pressure cannot be supplied into the boom lowering side chamber 3*b* in the boom actuating cylinder 3*b*.

Figure 4:
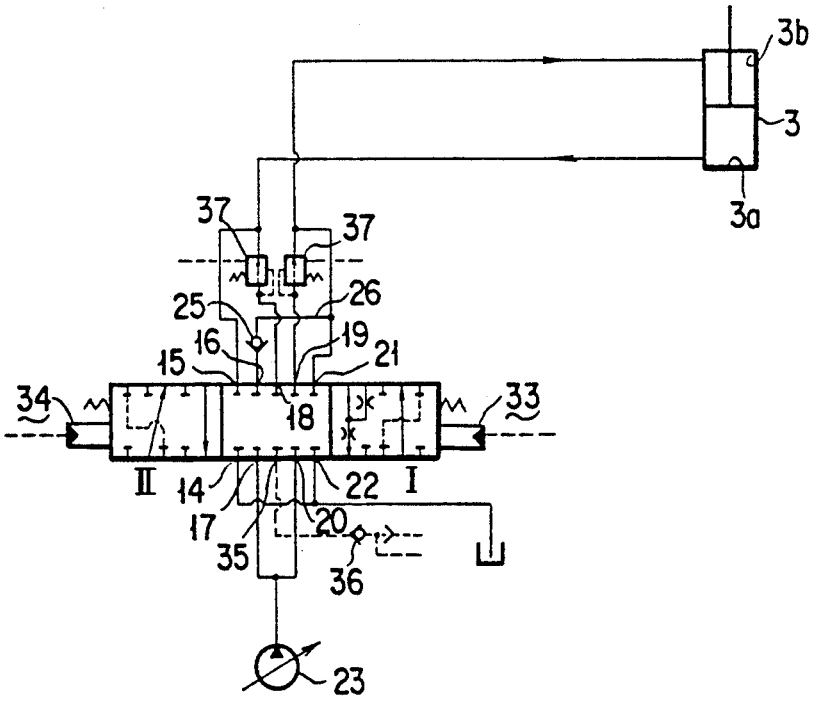
FIG. 4 is a diagrammatic explanatory view of the operating valve used in the embodiment shown in FIG. 2.
Figure 5:
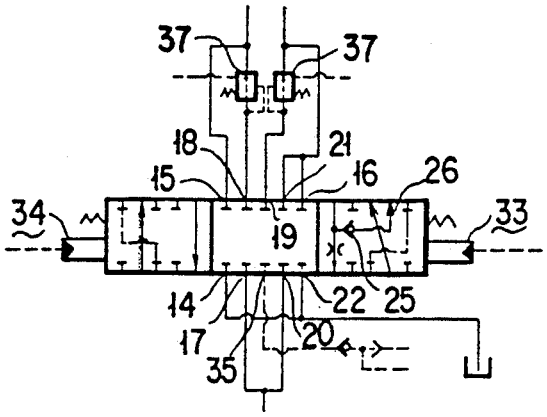
FIG. 5 is a diagrammatic explanatory view of a modification of the operating valve which can be used in the first embodiment.

The above-mentioned operating valve for actuating the work implement or the boom is diagrammatically shown in FIG. 4, but alternatively, it may be constructed as shown in FIG. 5.

In FIGS. 4 and 5, the pressure either in the first port 15 or in the second port 21 is detected by a pressure detection port 35, and the detected pressure is compared by a shuttle valve 36 with the pressure detected by another operating valve, and as a result, the higher pressure is transmitted to a pressure compensating valve 37 so that it may be set by the higher pressure, thus rendering it possible to supply the fluid under pressure discharged by one and the same pump into boom actuating cylinders imposed with different loads when operating a plurality of operating valves simultaneously.

The above-mentioned embodiment is directed to a hydraulic circuit apparatus for operating a boom actuating cylinder suitable for use in an earth compacting operation, but the work implement of this kind is us for other operations, and in such operations quick operations of the boom is required.

A second embodiment of the present invention which will be described hereinbelow is concerned with a hydraulic circuit apparatus for quick operation of work implement.

Figure 6:
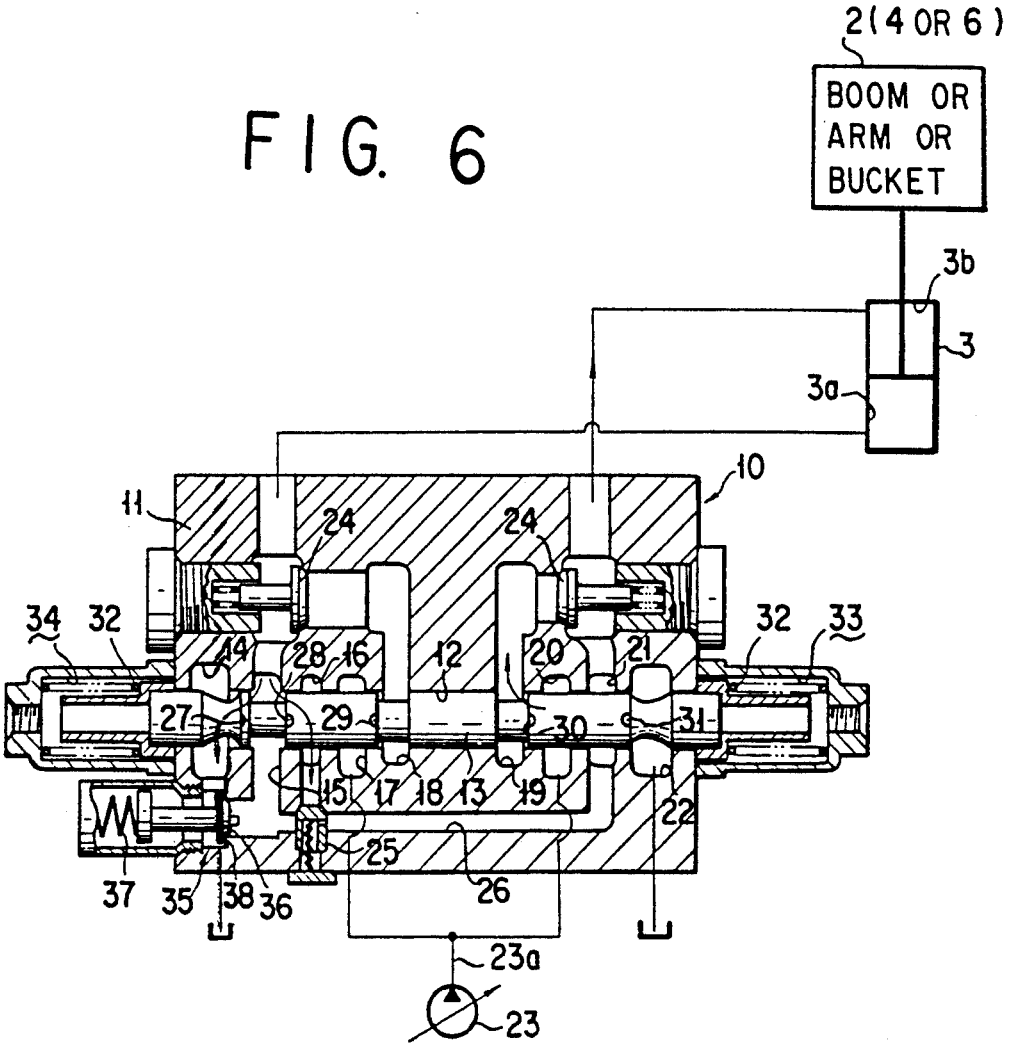
FIG. 6 is an overall, schematic configurational view showing a second embodiment of the present invention.

As shown in FIG. 6, an operating valve 10 is connected to a discharge passage 23*a* of a pump 23, and the arrangement is made such that when the operating valve 10 is changed over the fluid under pressure discharged by the pump 23 can be supplied either into the boom lifting side chamber 3*a* of the boom actuating cylinder 3, or into the boom lowering side chamber 3*b* thereby moving the work implement or boom 2 up or down.

The above-mentioned operating valve 10 comprises a spool 13 slidably inserted in a spool hole 12 formed in a valve body 11. The spool hole 12 in the valve body 11 has formed in turn therewith in longitudinally spaced-apart relationship a first tank port 14, a first port 15, a regenerative port 16, a first pump port 17, a first outlet port 18, a second outlet port 19, a second pump port 20, a second port 21, and a second tank port 22. The first and second tank ports 14 and 22 communicate with a fluid tank or reservoir. The first port 15 is connected to a boom lifting side chamber 3*a* of a boom actuating cylinder 3, whilst the second port 21 is connected to a boom lowering side chamber 3*b*. The first and second pump ports 17 and 20 are connected to the discharge passage 23*a* of the pump 20. Further, the first outlet port 18 is allowed to communicate through a check valve 24 with the first port 15, whilst the second outlet port 19 is allowed to communicate through a check valve 24 with the second port 21. The regenerative port 15 is allowed to communicate through a check valve 25 and a fluid passage 26 with the second port 21.

The above-mentioned spool 13 is formed with a first cut-away groove 27 for communicating the first tank port 14 with the first port 15, a second cut-away groove 28 for communicating the first port 15 with the regenerative port 16, a third cut-away groove 29 for communicating the first pump port 17 with the first outlet port 18, a fourth cut-away groove 30 for communicating the second outlet port 19 with the second pump port 20, and a fifth cut-away groove 31 for communicating the second port 21 with the second tank port 22. The spool 13 is held at its neutral position by the resilient force of a spring 32, and is changed over to a first actuating position I by the action of pilot fluid under pressure supplied into a first pressure receiving chamber 33, and also to a second actuating position by the action of pilot fluid under pressure supplied into a second pressure receiving chamber 34.

Figure 7:
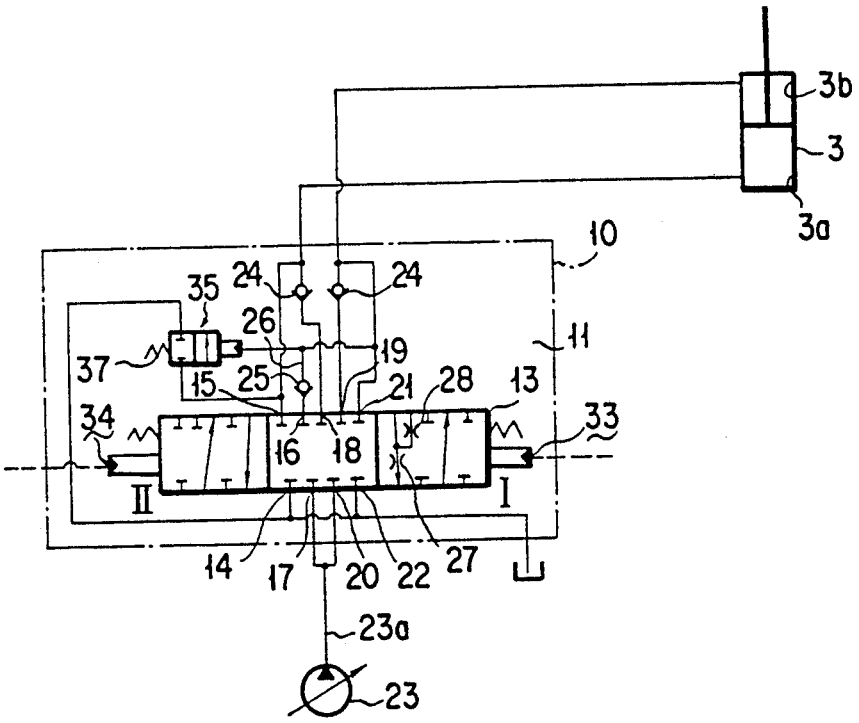
FIG. 7 is a diagrammatic explanatory view of the operating valve used in the embodiment shown in FIG. 6.

The above-mentioned first tank port 14 is arranged to be connected with and disconnected from the first port 15 through the intermediary of a speed change-over valve 35 which comprises a valve 36 urged by the resiliency of a spring 32 against a seat 38. The above-mentioned configuration is shown diagrammatically shown in FIG. 7.

The operation of the second embodiment will be described below.

When the spool 13 is slidably moved to the second actuating position to the right hand in the drawing by supplying pilot fluid under pressure into the second pressure chamber 34, the first port 15 is connected through the first cut-away 27 with the first tank port 14, and at the same time the first port 15 is allowed to open into the regenerative port 16 through the second cut-away groove 28, and the second pump port 20 is allowed to open into the second outlet port 19 through the fourth cut-away groove 30.

As a result, the fluid under pressure discharged by the pump 23 is supplied into the boom lowering side chamber 3*b*, whilst the fluid under pressure within the boom lifting side chamber 3*b* will flow into the first tank port 14 and the regenerative port 16, and then through the regenerative port 16 into the check valve 25 after pushing it open, and then flow through the fluid passage 26 and the second port 21 into boom lowering side chamber 3*b*. In consequence, fluid under pressure is supplied into the boom lowering side chamber 3*b* of the boom actuating cylinder at a flow rate equivalent to the rate of flow discharged by the pump plus $\alpha$, thus increasing the retracting speed of the piston rod in the boom actuating cylinder 3.

Stating in brief, since a holding pressure is generated by the weight of the work-implement or the boom 2 in the boom lifting side chamber 3*a* of the boom actuating cylinder 3 and is higher than the pressure in the boom lowering side chamber 3*b*, the fluid under pressure within the boom lifting side chamber 3*a* is supplied into the boom lowering side chamber 3*b*.

Further, since the fluid under pressure returning from the boom lifting side chamber flows also through the first cut-away groove 27 into the first tank port 14, the flow rate of fluid under pressure to be supplied into the boom lowering side chamber 3*b* can be controlled by varying the area of opening of the first cut-away groove 27 and the second cut-away groove 28 so that the retracting speed of the piston rod in the boom actuating cylinder 3 can be adjusted.

Further, when the pressure of the fluid under pressure in the fluid passage 26 becomes higher, the valve 36 of the speed change-over valve 35 is pushed by the fluid pressure away from the seat 38, the fluid under pressure discharged by the pump 23 and flowing through the first outlet port 18 towards the boom lifting side chamber 3*a* will partially flow through the first tank port 14 into the fluid tank so as to reduce the flow rate of the fluid under pressure to be supplied into the boom lifting side chamber 3*a* is reduced. Therefore, the operating speed of the piston rod in the boom actuating cylinder 3 can be varied by regulating the fluid pressure in the fluid passage 26.

Further, since the check valve 25 is provided in the above-mentioned fluid passage 26, the flow of the fluid under pressure from the second outlet port 21 to the regenerative port 16 is blocked so that when the fluid pressure in the boom lowering side chamber 3*b* becomes higher than that in the boom lifting side chamber 3*a* the flow of the fluid under pressure from the boom lowering side chamber 3*b* into the boom lifting side chamber 3*a* can be prevented.

We claim:

1. A hydraulic circuit apparatus for operating a work implement actuating cylinder so as to supply pressurized fluid discharged by a hydraulic pump through a closed-center type operating valve into a work-implement lowering side chamber and a work-implement lifting side chamber of the work implement actuating cylinder, the hydraulic circuit apparatus comprising:

a spool slidably inserted in a valve hole formed in said operating valve, said valve hole having formed therewith in a longitudinal spaced apart relationship, a first tank port, a first port connected with said work-implement lifting side chamber, a first pump port, a second pump port, a second port connected with said work-implement lowering side chamber and a second tank port, said spool being movable between a first actuating position (I) where said second port is communicated with said second tank port, and said first port is communicated with said first pump port, and a second actuating position (II) where said second port is communicated with said second pump port, and said first port is communicated with said first tank port;

a regenerative fluid passage formed in said operating valve so as to allow said first port to communicate with said second port, said spool being so constructed and arranged that, as said spool moves toward said second actuating position. communication between said first tank port and said first port is established before communication between said second pump port and said second port is established; and a check valve mounted in said regenerative fluid passage.

2. A hydraulic circuit apparatus for operating a work-implement actuating cylinder as claimed in claim 1, characterized in that it is constructed such that when said spool is moved to its second actuating position said first port is communicated through said regenerative fluid passage with said second port so that the fluid under pressure in said work-implement lifting side chamber is supplied together with the fluid under pressure discharged by said hydraulic pump into said work-implement lowering side chamber.

3. A hydraulic circuit apparatus for operating a work-implement actuating cylinder so as to supply pressurized fluid discharged by a hydraulic pump through a closed-center type operating valve into a work-implement lowering side chamber and a work-implement lifting side chamber of the work implement actuating cylinder, the hydraulic circuit apparatus comprising:

a spool slidably inserted in a valve hole formed in said operating valve, said valve hole having formed therewith in a longitudinal spaced apart relationship, a first tank port, a first port connected with said work implement lifting side chamber, a first pump port, a second pump port, a second port connected with said work-implement lowering side chamber and a second tank port, said spool being movable between a first actuating portion (I) where said second port is communicated with said second tank port, and at the same time said first port is communicated with said first pump port, and a second actuating position (II) where said second port is communicated with said second pump port, and at the same time said first port is communicated with said first tank port; a regenerative fluid passage formed in said operating valve so as to allow said first port to communicate with said second port; and said check valve mounted in said regenerative fluid passage, said apparatus being constructed such that when said spool is moved from a neutral position towards said second actuating position where the fluid under pressure discharged by the hydraulic pump is supplied into said work-implementing lowering side chamber, only the metering-out side is opened, and at the same time, said first port is communicated through said regenerative fluid passage with said second port, and subsequently when the spool is further moved to is second actuating position to said pump port on a metering-in side is communicated with said second port in the condition wherein the first port is kept in communication through said regenerative passage with the second port.

4. A hydraulic circuit apparatus for operating a work-implement actuating cylinder so as to supply pressurized fluid discharged by a hydraulic pump through a closed-center type operating valve into a work-implement lowering side chamber and a work-implement lifting side chamber of the work-implement actuating cylinder, the hydraulic circuit apparatus comprising: a spool slidably inserted in a valve hole formed in said operating valve, said valve hole having formed therewith, in a longitudinally spaced-apart relationship, a first tank port, a first port connected with said work-implement lifting side chamber, a regenerative port, a first pump port, a first outlet port, a second outlet port, a second pump port, a second port connected with said work-implement lowering side chamber and a second tank port, said spool having formed therein a first cut-away groove for communicating said first tank port with said first port, a second cut-away groove for communicating said first port with said regenerative port, a third cut-away groove for communicating said first pump port with said first outlet port, a fourth cut-away groove for communicating said second outlet port with said second pump port, and a fifth cut-away groove for communicating said second port with said second tank port; a first passage and a first check valve mounted in said first passage for communicating said first outlet port with said first port; a second passage and a second check valve mounted in said second passage for communicating said second outlet port with said second port; a regenerative fluid passage formed in said operating valve and a third check valve mounted in said regenerative passage for communicating said regenerative port with said second port, said spool movable between a first actuating position (I) where said second port is communicated with said second tank port via said fifth cut-away groove, and at the same time said first port is communicated with said first pump port via said third cut-away groove, said first outlet port, said first passage and said first check valve, and a second actuating position (II) where said second port is communicated with said second pump port via said fourth cut-away groove, said second outlet port, said second passage and said second check valve, and at the same time said first port is communicated with said first tank port via said first cut-away groove.

5. A hydraulic circuit apparatus for operating a work-implement actuating cylinder as claimed in claim 4, characterized in that it is constructed such that when said spool is moved from its neutral position towards its second actuating position (II) where the fluid under pressure discharged by said hydraulic pump is supplied into said work-implement lowering side chamber, only a metering-out side is opened, and at the same time, said first port is communicated with said second port via said second cut-away groove, said regenerative port, said regenerative fluid passage and said third check valve, and subsequently when the spool is further moved to its second actuating position said second pump port on a metering-in side is communicated with said second port in the condition wherein the first port is kept in communication with said second port.

6. A hydraulic circuit apparatus for operating a work-implement actuating cylinder as claimed in claim 4, characterized in that it is constructed such that when said spool is moved to its second actuating position (II) said first port is communicated with said second port through said second cut-away groove, said regenerative port, said regenerative fluid passage and said third check valve so that the fluid under pressure in said work-implement lifting side chamber is supplied together with the fluid under pressure discharged by said hydraulic pump into said work-implement lowering side chamber.

* * * * *